US006511445B2

(12) United States Patent
Sivan et al.

(10) Patent No.: US 6,511,445 B2
(45) Date of Patent: Jan. 28, 2003

(54) CELLULITE MASSAGE SYSTEM WITH GEL DISPENSER

(75) Inventors: Avi Sivan, New York, NY (US); Prem Ramchandani, New York, NY (US)

(73) Assignee: Tactica International, Inc., New York, NY (US)

( * ) Notice: Subject to any disclaimer, the term of this patent is extended or adjusted under 35 U.S.C. 154(b) by 0 days.

(21) Appl. No.: 09/342,211

(22) Filed: Jun. 29, 1999

(65) Prior Publication Data

US 2002/0151827 A1 Oct. 17, 2002

Related U.S. Application Data

(63) Continuation-in-part of application No. 09/199,619, filed on Nov. 24, 1998.

(51) Int. Cl.[7] ..... A61H 1/00; A61H 1/02; A61H 7/00

(52) U.S. Cl. ..... 601/6; 601/17

(58) Field of Search ..... 601/6–15, 17, 601/126; 604/789, 312, 313; 15/321, 322, 344; 606/131; 222/95, 207, 214; 401/143, 152, 158, 163, 6

(56) References Cited

U.S. PATENT DOCUMENTS

| | | | | | |
|---|---|---|---|---|---|
| 1,936,129 | A | * | 11/1933 | Fisk | 604/313 |
| 3,574,239 | A | * | 4/1971 | Sollerud | 4/616 |
| 3,970,078 | A | | 7/1976 | Rogers et al. | 128/57 |
| 4,086,922 | A | | 5/1978 | Henderson et al. | 128/24.3 |
| 4,274,588 | A | * | 6/1981 | Schwob | 239/138 |
| 4,292,971 | A | * | 10/1981 | Smit et al. | 604/23 |
| 4,813,404 | A | | 3/1989 | Vallis et al. | 128/57 |
| 4,827,105 | A | * | 5/1989 | Brown, Jr. | 392/385 |
| 4,883,047 | A | * | 11/1989 | Guitay | 601/7 |
| 5,507,068 | A | * | 4/1996 | Fan et al. | 15/320 |
| 5,523,090 | A | * | 6/1996 | Znaiden et al. | 424/401 |
| 5,587,396 | A | * | 12/1996 | Smith | 514/557 |
| 5,662,593 | A | * | 9/1997 | Tillman | 601/159 |
| 5,665,053 | A | * | 9/1997 | Jacobs | 601/6 X |
| 5,961,475 | A | * | 10/1999 | Guitay | 601/7 |
| 6,017,320 | A | * | 1/2000 | Bleeker et al. | 601/125 |
| D423,677 | S | * | 4/2000 | Sivan et al. | D24/215 |
| 6,277,052 | B1 | * | 8/2001 | Howard | 482/4 |
| 2002/0058892 | A1 | * | 5/2002 | Young | 601/96 |

* cited by examiner

*Primary Examiner*—Denise M. Pothier
(74) *Attorney, Agent, or Firm*—Catherine M. Voorhees; Venable

(57) ABSTRACT

A cellulite massage system includes a body having a bottom surface, means for producing suction to create a massage action at the bottom surface, and a built-in gel dispenser in said body for dispensing gel to the bottom surface. The invention also provides a method for treating the appearance of cellulite including the steps of applying suction to an area of a body containing cellulite so as to massage that area, and applying gel to that area so as to improve the texture and look of skin on the treated area of the body.

12 Claims, 10 Drawing Sheets

CELLULITE MASSAGE SYSTEM WITH GEL DISPENSER

CROSS-REFERENCE TO RELATED APPLICATIONS

This application is a continuation-in-part of co-pending application Ser. No. 09/199,619, filed Nov. 24, 1998; and a continuation-in-part of the co-pending design application entitled "CELLULITE MASSAGE SYSTEM", filed Jun. 1, 1999.

BACKGROUND OF THE INVENTION

1. Field of the Invention

This invention relates to a cellulite massage system with a gel dispenser which helps to improve the unsightly appearance of cellulite and stretch marks. Specifically, the invention uses vacuum therapy in conjunction with creme dispensing. That is, the present invention combines a massager means for producing suction such as a suction pump, and a built-in massage gel dispenser.

2. Background

Known methods and apparatuses for treating areas of the human body having cellulite only use rollers or balls to create the massaging action and do not use creme or a gel. U.S. Pat. No. 4,086,922 to Henderson relates to a method and apparatus for applying heat and a rolling massage pressure on the areas of the body having cellulite therein. A hand roller massage is shown in U.S. Pat. No. 3,970,078 to Rogers, Jr. that also can be used on cellulite. Henderson's apparatus employs of plurality of closely spaced heated balls, while the device of Rogers, Jr. uses rollers for the massaging action. Neither of these devices uses a creme or a gel.

U.S. Pat. No. 4,813,404 to Vallis is directed to an applicator implement for massaging the body and for spreading lotion or creme over the body. The massager disclosed by Vallis has a series of wheels mounted on an axle, which are used to massage the body at the same time that lotion or creme is spread over portions of the body. While the spreading of a creme is disclosed as part of Vallis' invention, Vallis specifically states that its invention does not have a dispenser associated with the applicator implement. Thus, even though Vallis discloses massaging of the body and the use of cremes, it does not disclose a device for dispensing the creme while massaging.

This invention differs from the prior art in that a different technology is used to massage areas of the human body containing cellulite that satisfies a void in the market regarding issues of cellulite. Further, the combination of suction or vacuum therapy and a gel dispenser improves the texture of the treated skin, as well as the look of the skin.

SUMMARY OF THE INVENTION

In summary, the instant invention utilizes vacuum therapy in conjunction with a gel dispenser to improve the unsightly appearance of cellulite and stretch marks with the novel cellulite massage system with gel dispenser.

It is an object of the instant invention to employ means for producing suction such as a suction pump as the massaging, implement of the cellulite massage system. The vacuum therapy or suction treatment lifts the skin and breaks the cellulite up providing a more effective massage that improves the appearance of the body treated.

It is a further object of the invention to provide a gel dispenser in combination with a cellulite massage device.

The combination of gel dispenser and cellulite massage system improves the texture and look of the skin after treatment.

Thus, the invention is a cellulite massage system that comprises a body having a bottom surface, means for producing suction to produce a massage action at the bottom surface, and a built-in gel dispenser in the body for dispensing gel to the bottom surface.

The invention also provides a method for treating the appearance of cellulite comprising the steps of applying suction to an area of a body containing cellulite so as to massage that area, and applying gel to that area so as to improve the texture and look of skin on the treated area of the body.

Further objectives and advantages will become apparent from a consideration of the description and drawings.

BRIEF DESCRIPTION OF THE DRAWINGS

The invention is better understood by reading the following detailed description with reference to the accompanying figures, in which like reference numerals refer to like elements throughout, and in which.

DETAILED DESCRIPTION OF THE PREFERRED EMBODIMENTS

Figure 1:
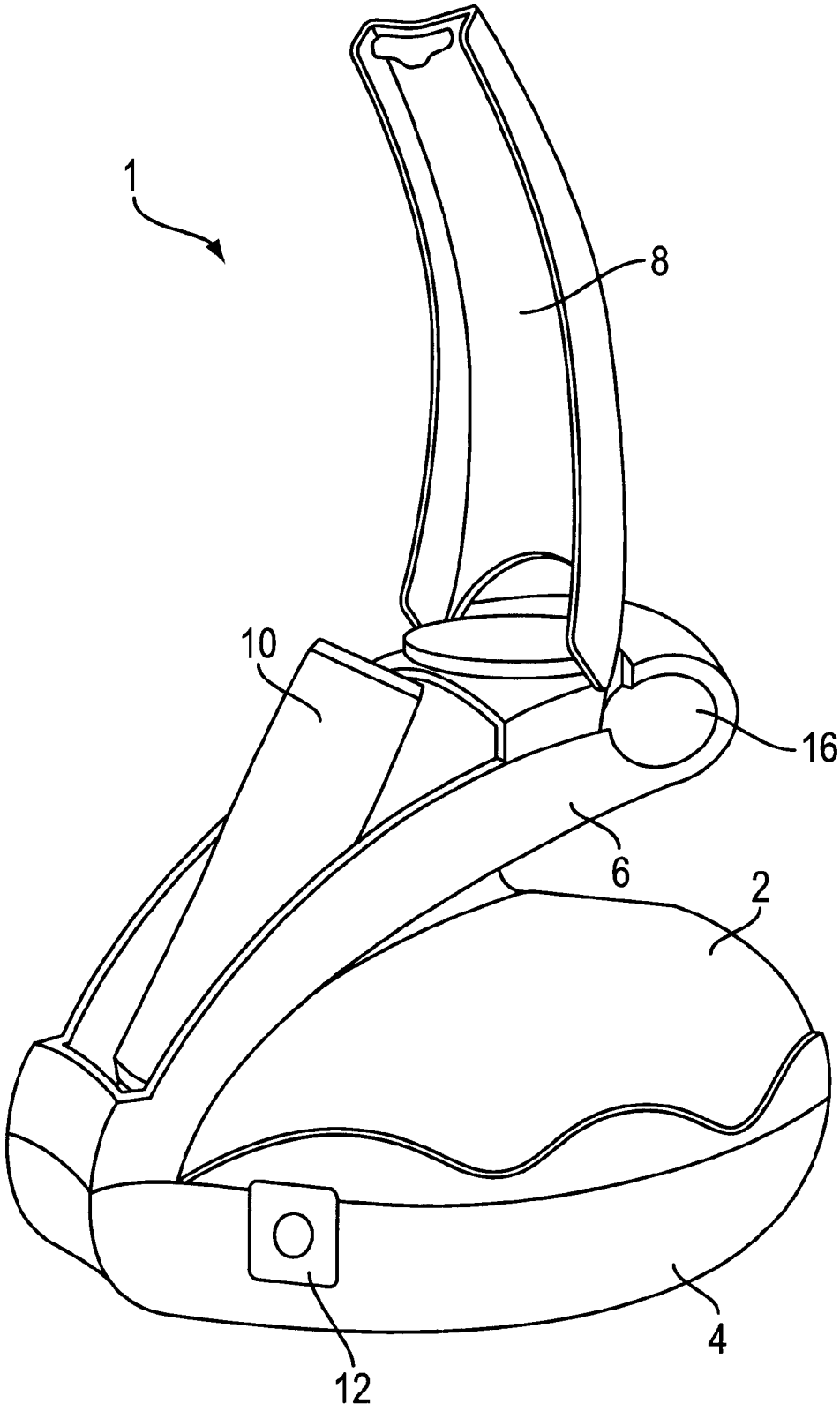
FIG. 1 is a perspective view of a cellulite massage system with gel dispenser according to the invention.

In describing preferred embodiments of the present invention illustrated in the drawings, specific terminology is employed for the sake of clarity. However, the invention is not intended to be limited to the specific terminology so selected. It is to be understood that each specific element includes all technical equivalents which operate in a similar manner to accomplish a similar purpose. Each reference cited here is incorporated by reference as if each were individually incorporated by reference.

Referring to FIG. 1, a cellulite massage system 1 with a built-in gel dispenser according to the invention is shown. Cellulite massage system 1 is in the form of a body or housing which has a top 2 and a base 4 that can be two separate molded pieces. Top 2 has a handle 6 which is ergonomically designed so that one hand of a user can comfortably hold the cellulite massage system while applying the gel and massaging areas of the user's body where cellulite or stretch marks are present.

Handle 6 has a cover 8 that pivots on the handle to expose the gel tube 10 that is inserted in the base 4 of the cellulite massage system 1 for dispensing gel or creme while the cellulite massage system 1 treats an area of a user's body. Cover 8 preferably snaps shut over gel tube 10 to complete handle 6. While a tube is shown as a preferred embodiment, any source of creme or a gel can be used in the instant invention. In a preferred embodiment, cover 8 pivots upward from the base so that a user of the cellulite massage system 1 can easily access gel tube 10 to add another creme or gel if the previously inserted gel tube is empty or if another type of creme is desired.

Figure 2:
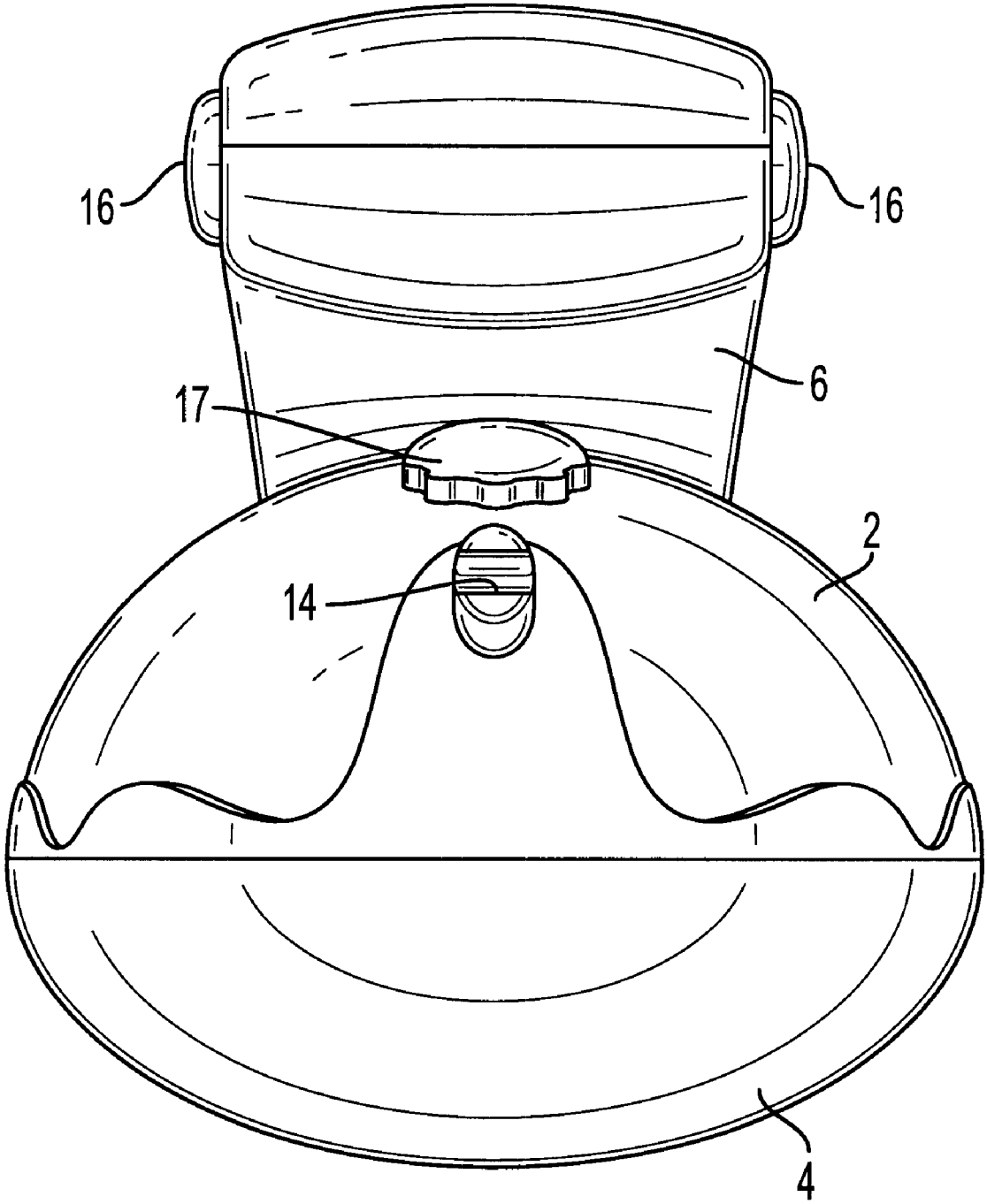
FIG. 2 is a rear elevational view of the cellulite massage system according to the invention.

Cellulite massage system 1 preferably uses ordinary household current and thus, an electrical outlet 12 is provided in base 4 for receiving a plug to energize the cellulite massage system. To actuate the suction a user would turn on/off switch 14 into the ON position as shown in FIG. 2. A user would then push buttons 16 which are respectively located on either side of the upper end of handle 6 to dispense the desired amount of gel. The amount of suction can be regulated by turning knob 17 that preferably is located on top 2 of the cellulite massage system. In another embodiment, batteries may be used to power the cellulite massage system. This would enable users of the cellulite massage system 1 to massage their body when no household current is available or convenient.

Figure 3:
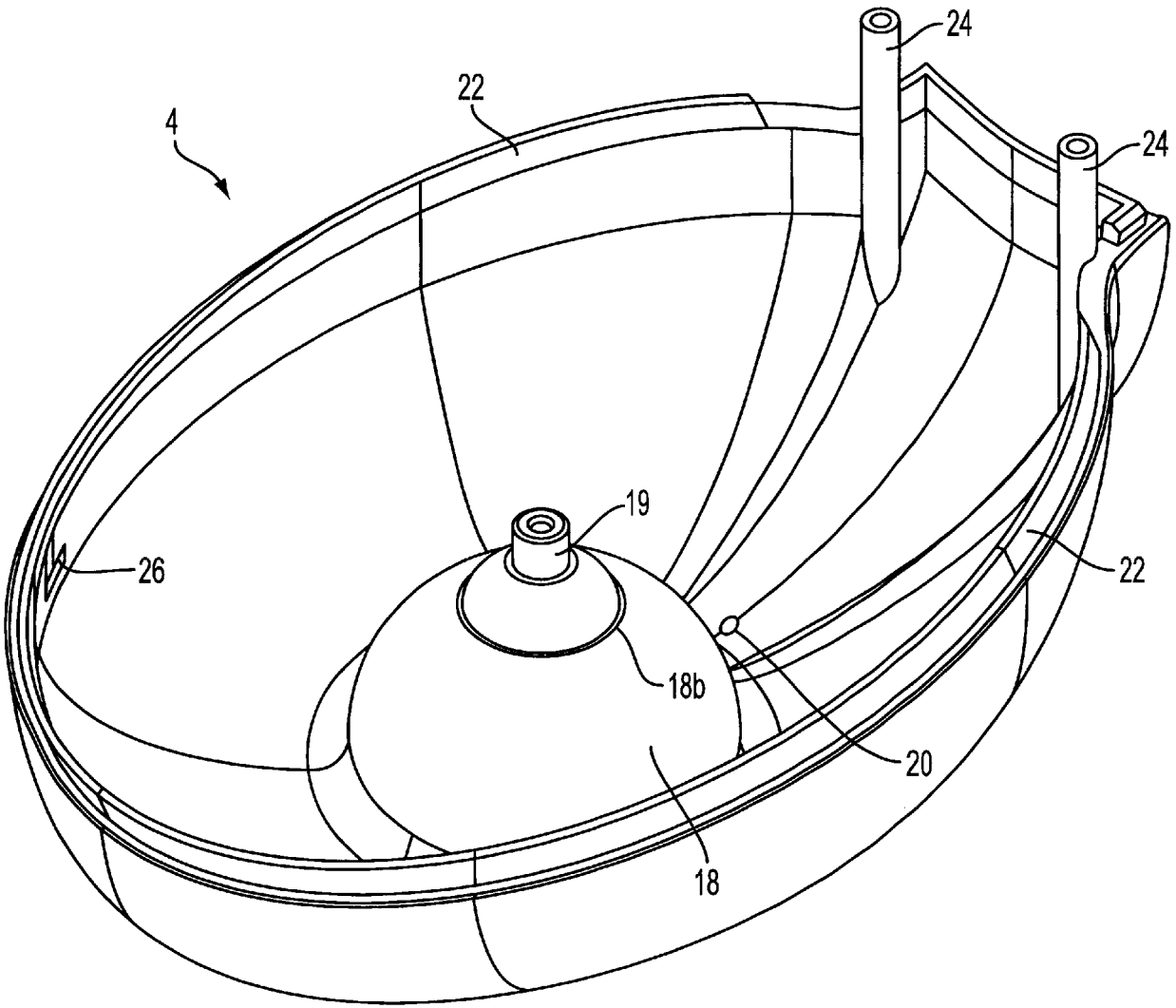
FIG. 3 shows the interior of the base of the cellulite massage system according to the invention.

The interior of base 4 without the electronics and mechanics is shown in FIG. 3. Base 4 has a suction bowl 18, which preferably is a recessed bowl with a rounded contour. A lower bottom portion 18*b* of suction bowl 18 is provided with a suction opening 18*o* to which a connector 19 is attached via tubes to a suction pump. In addition, a gel opening 20 is disposed slightly behind suction bowl 18 in base 4. Gel opening 20 is connected to gel tube 10 via tubes and a dispenser as described below.

Base 4 is preferably molded to include an inset ridge 22 along the upper portion of the base. Cylindrical tubes 24 receive screws after top 2 is attached to base 4 to secure both parts of cellulite massage system 1. Preferably, these tubes 24 are located at the front of base 4 so that when top 2 is attached, tubes 24 can be accessed when cover 8 is pivoted in the open position. Additionally, openings 26 on either side of the back of base 4 receive prongs attached to top 2 to further secure top 2 and base 4.

Figure 4:
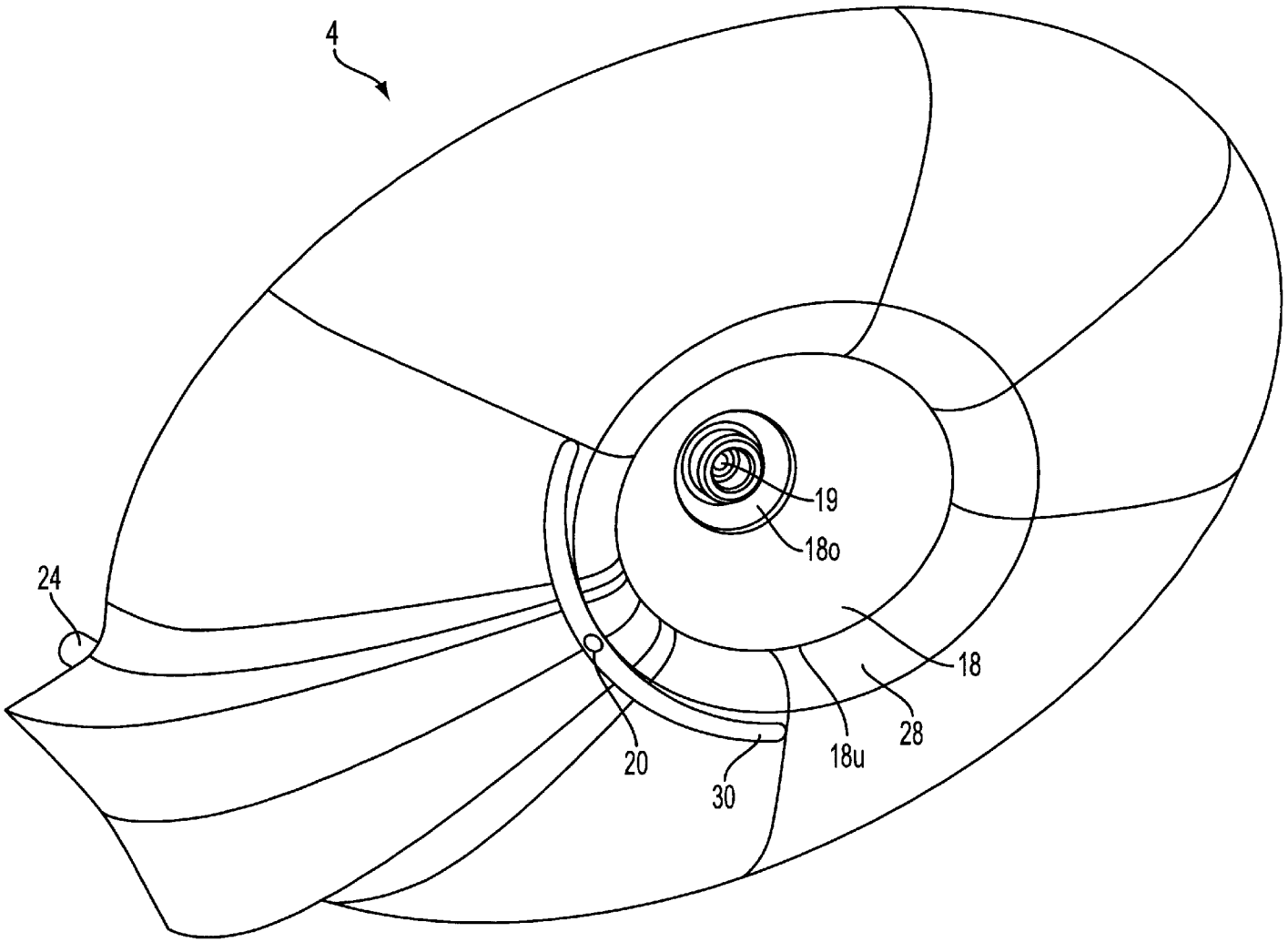
FIG. 4 shows the bottom surface of the cellulite massage system according to the invention.

Looking at FIG. 4, which shows the bottom surface of base 4, it can be seen that the bottom surface includes a ridge 28 around an upper edge 18u of suction bowl 18. Ridge 28 is slight and, as such, is not obvious to the average viewer. However, if one's hand is moved flush against the bottom surface of base 4, ridge 28 would be felt. This slight ridge 28 enables the vacuum to be created between suction bowl 18 and a user's body. In a preferred embodiment, ridge 28 may be two to three millimeters in height from the base. Gel opening 20 is located just behind ridge 28 is a groove or trough 30 that encircles approximately the front third of suction bowl 18. Groove 30 keeps the gel in front of suction bowl 18 where the same is smoothed into the skin of a treated area by ridge 28. Thus, the gel is dispensed to the skin before the skin is subjected to the vacuum therapy by suction bowl 18. As a result of the built-in dispenser of the cellulite massage system according to the invention, a user's skin is made supple by the emollients of the gel or creme prior to the suction treatment and the gel or creme does not interfere with the creation of the vacuum.

The term "front" refers to direction of applying gel and/or treating an area of a body. "Front" means the portion of the cellulite massage system before the suction structure.

Figure 5:
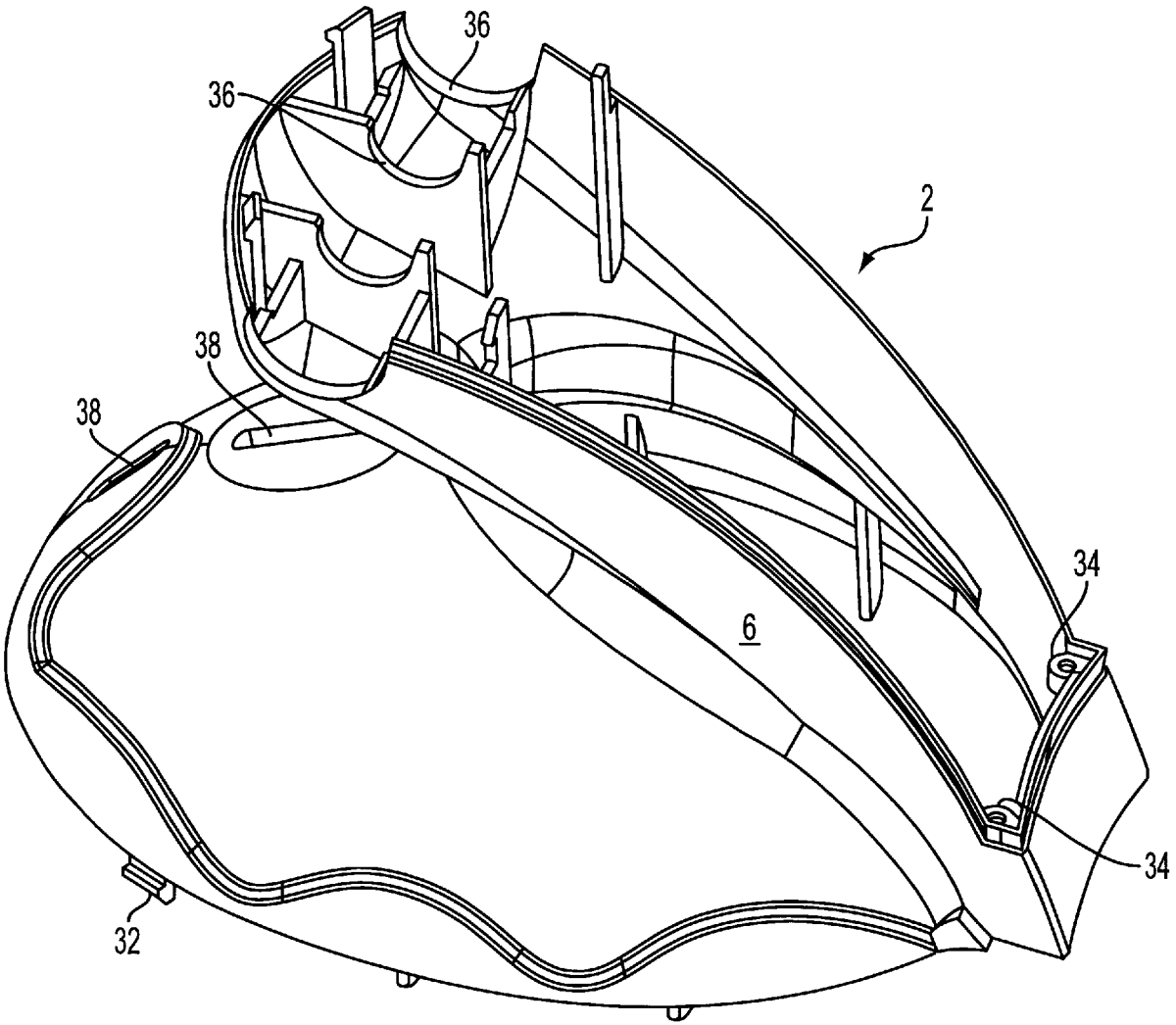
FIG. 5 is a view of the top of the cellulite massage system according to the invention without the dispenser lid.

FIG. 5 shows top 2 of cellulite massage system 1 without the dispenser lid or cover 8, on/off switch 14, gel dispensing buttons 16, and regulator knob 17. Top 2 can be molded so that prongs 32 extend from the bottom of top 2. Prongs 32 fit in openings 26 of base 4 to secure the two separate parts together. In addition, screw ears 34 are molded to top 2 for receiving screws that are tightened into tubes 24 of base 4. Gel dispensing buttons 16 are received in grooves 36 of handle 6. On/off switch 14 and regulator knob 17 are inserted through respective holes 38 in top 2.

Figure 6:
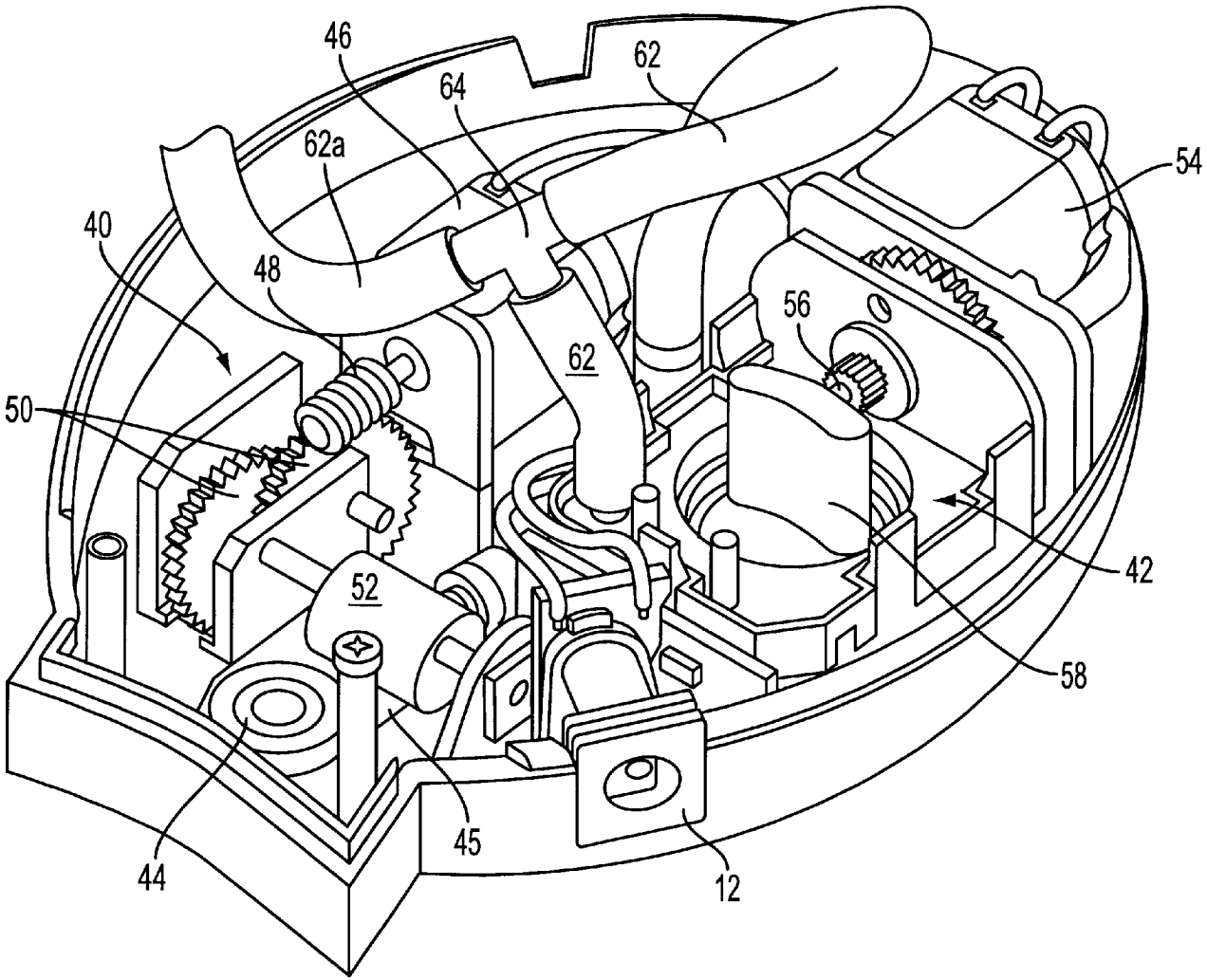
FIG. 6 shows the base of the cellulite massage system according to the invention with the mechanisms for the suction pump and gel dispenser.

The mechanics of cellulite massage system 1 are shown in FIG. 6 where arrow 40 is directed to the gel dispensing mechanics and arrow 42 is directed to the suction pump mechanics. First, a preferred gel dispensing arrangement will be described. An opening of gel tube 10 is inserted in seal 44 so that gel can be dispensed to groove 30 of cellulite massage system 1. A tube 45 extends from seal 44 to gel opening 20. Seal 44 is preferably a vacuum seal that keeps dirt and air out of tube 45. When gel dispensing buttons 16 are pushed, gel dispensing motor 46 is energized turning a shaft with screw threads 48. Shaft 48 turns gears 50 causing an off-centered cylinder 52 to rotate over tube 45. The off-centered nature of cylinder 52 pumps gel through tube 45 and into groove 30 when buttons 16 are pushed.

Figure 7:
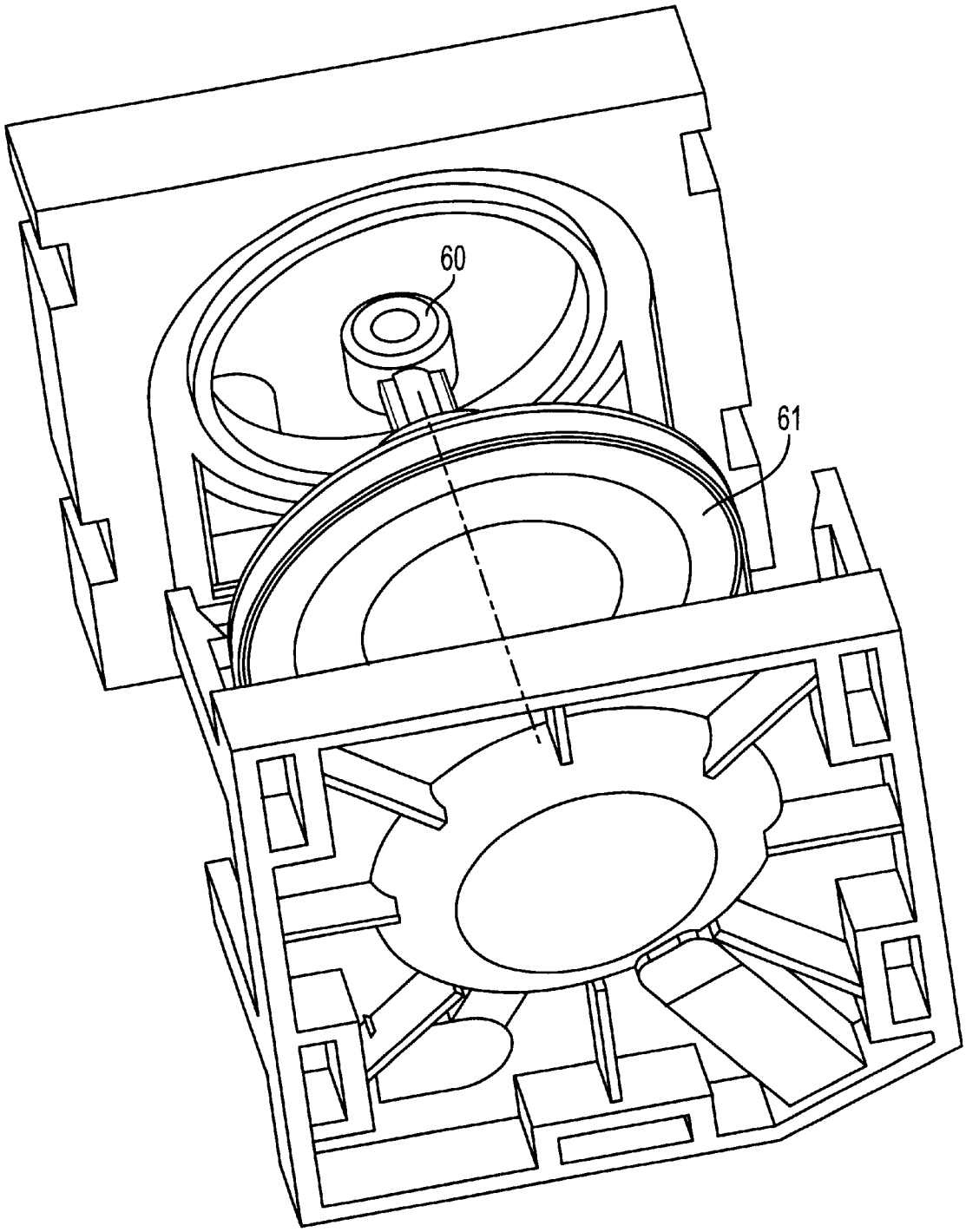
FIG. 7 is an explosive view of the vacuum pump shown in FIG. 6.
Figure 8:
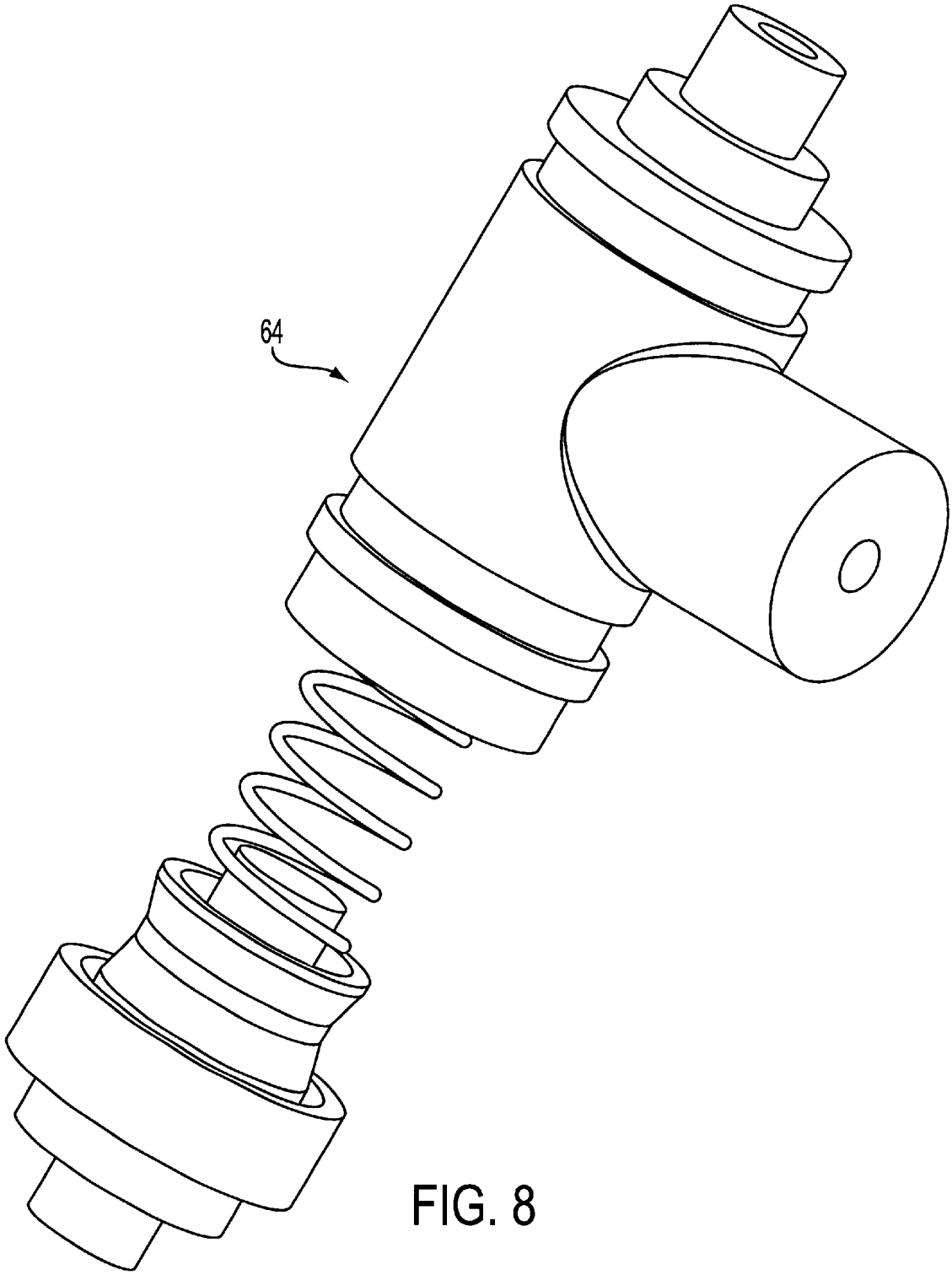
FIG. 8 is an enlarged view of the vacuum gauge in FIG. 6.
Figure 9:
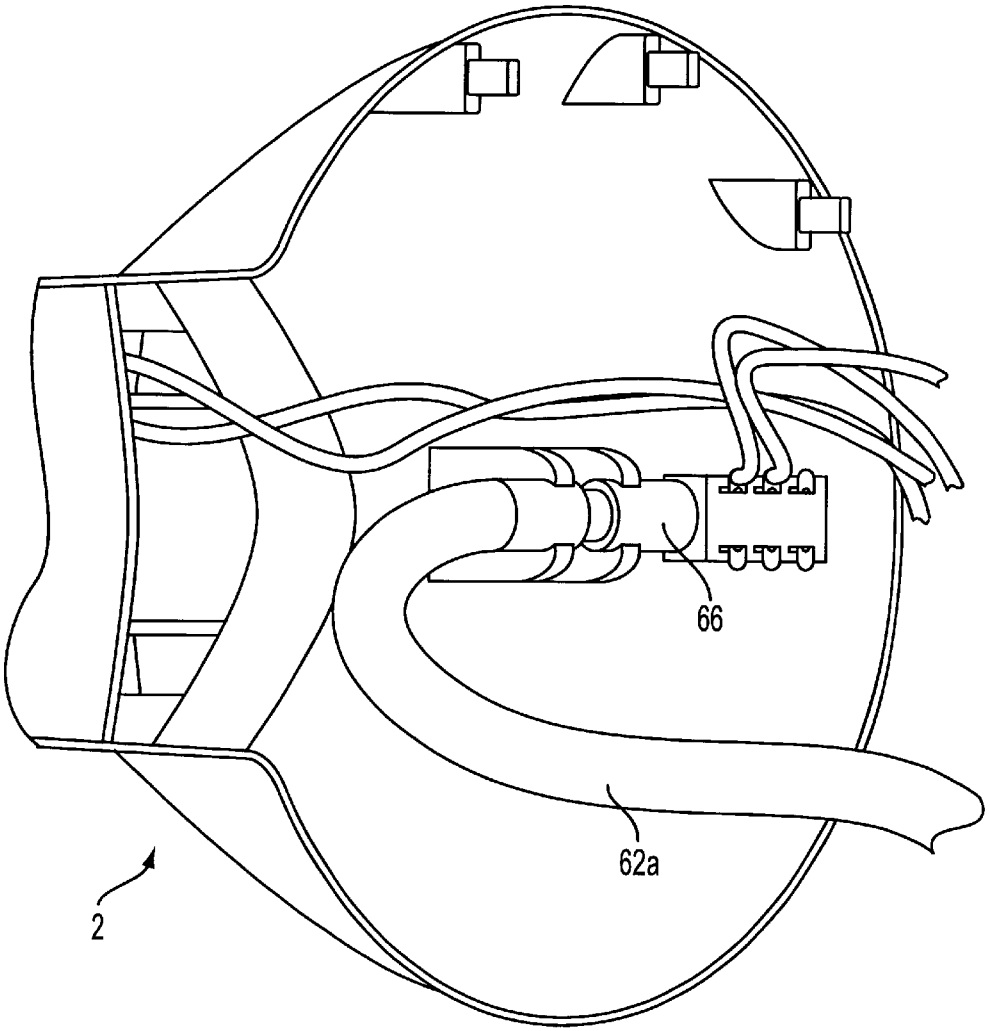
FIG. 9 shows the interior of the top of the cellulite massage system according to the invention.

When on/off switch 14 is turned to the ON position, motor 54 of the suction pump is activated. Motor 54 has a shaft that is connected at a right angle to another shaft so that an off-centered cam is created. Thus, the rotation of the motor's shaft with this off-centered shaft results in an eccentric rotation at shaft 56 which is attached through a rubber boot 58 to a rod 60 of the vacuum pump as shown in FIG. 7. The up-and-down motion of rod 60 in conjunction with diaphragm 61 causes a vacuum or suction to form in suction bowl 18. Air is sucked from outside through tubing 62 creating a vacuum in suction bowl 18. A one-way valve or vacuum gauge 64 does not allow air to escape from the pump. A preferred vacuum gauge is shown in FIG. 8. The strength of the suction is regulated by knob 17 as described below with reference to FIG. 9.

The left-hand tube 62*a* of FIG. 6 is the breathing tube. Breathing tube 62*a* is connected to a valve 66 that is actuated by regulator knob 17. By turning regulator knob 17, valve 66 is opened and closed thereby adjusting the strength of suction obtained by the vacuum pump of cellulite massage system 1.

Figure 10:
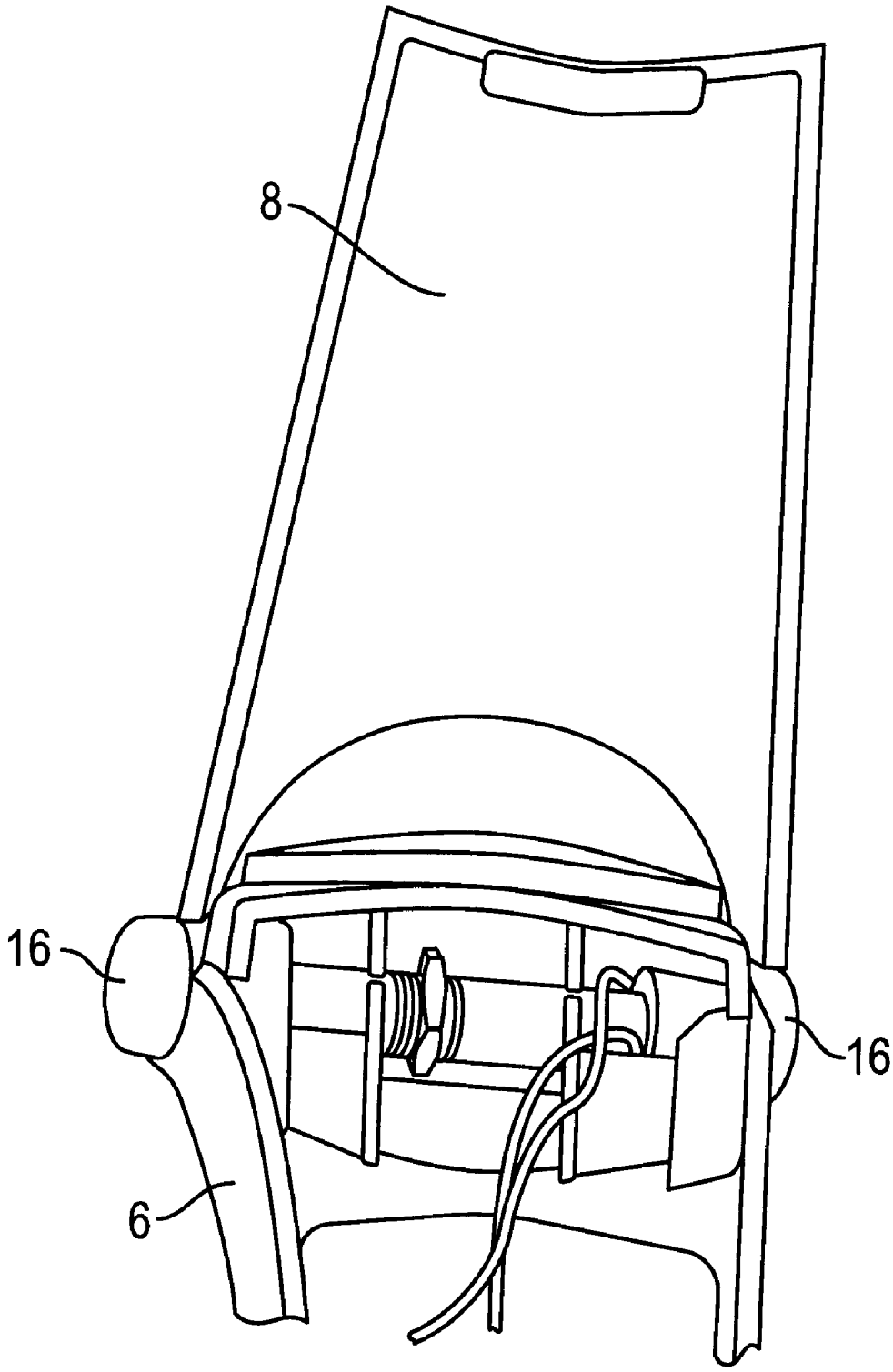
FIG. 10 shows the actuating member of the gel dispenser of the cellulite massage system according to the invention.

FIG. 10 shows the actuating member of the gel dispenser of the cellulite massage system. When buttons 16 are pushed, a circuit is closed energizing motor 46. Thus, the actuating member is between buttons 16 of FIG. 10.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. For example, a vibrator and gel dispenser combination is one variation. It is therefore to be understood that, within the scope of the claims and their equivalents, the invention may be practiced otherwise than as specifically described.

What is claimed is:

1. A cellulite massage system comprising:

a housing having a bottom surface, a top and a base, said bottom surface being on said base and being adapted for direct communication with an area of skin to be massaged, said bottom surface further having a recessed bowl with a rounded contour including an upper edge and a lower bottom a portion of, said bottom surface surrounding said upper edge of said recessed bowl;

massager means for producing suction to create a massage action at said bottom surface and for massaging the area of skin, said massager means includes a suction opening formed in a portion of said lower bottom of said recessed bowl; and means for dispensing one of gel and creme to said bottom surface wherein the produced suction massages the area of skin and a dispensed gel or creme treats the area of skin being massaged.

2. The cellulite massage system of claim 1, wherein said top has a handle which includes buttons for activating said means for dispensor, and dispensing gel to said bottom surface.

3. The cellulite massage system of claim 1, wherein the means for dispensing gel is a built-dispenser comprising a motor situated in said base, a cylinder which rotates off centered when said motor is energized, and a tube extending from a seal to a gel opening in said base, said off-centered cylinder pumping gel through said tube to the gel opening.

4. The cellulite massage system of claim 1, wherein said suction opening is connected to a pump for producing suction, and said base further comprises a gel opening where said gel opening is located in a trough in said bottom surface.

5. The cellulite massage system of claim 4, wherein said trough is located in front of said recessed bowl so that gel is applied before a suction treatment is received.

6. The cellulite massage system of claim 1, wherein the means for producing suction has a regulator for controlling the strength of the suction.

7. The cellulite massage system of claim 1, wherein the housing has a handle so that a user can dispense gel and massage with one hand.

8. The cellulite massage system of claim 1, wherein said means for dispensing is a built-in dispenser and includes one of a source of gel and creme.

9. The cellulite massage system of claim 1, wherein the top has a pivotable cover for access to a tube of gel or creme.

10. A cellulite massage system comprising:

a housing having a top and a base with a bottom surface, said bottom surface having a recessed bowl including an upper edge and a lower bottom, a portion of said bottom surface surrounding said upper edge of said recessed bowl, said bottom surface being adapted for direct communication with an area of skin to be massaged;

massager means for producing suction to create a massage action at said bottom surface and for massaging the area of skin, said massager means includes a suction opening formed in a portion of said lower bottom of said recessed bowl; and a built-in gel dispenser in said housing for dispensing gel to said bottom surface wherein said base has a gel opening for receiving a dispensed gel.

11. A cellulite massage system comprising:

a housing having a top and a base with a bottom surface, said bottom surface being adapted for direct communication with an area of skin to be massaged;

means for producing suction to create a massage action at said bottom surface; and a built-in gel dispenser in said housing for dispensing gel to said bottom surface wherein said base has a gel -opening for receiving the dispensed gel, said bottom surface has a suction bowl, said suction bowl being connected to said means for producing suction, and said gel opening is located in a trough in said bottom surface and the bottom surface has a ridge encircling said suction bowl.

12. The cellulite massage system of claim 11, wherein said ridge separates said suction bowl from said trough.

* * * * *